US008289111B2

(12) United States Patent
Naka et al.

(10) Patent No.: US 8,289,111 B2
(45) Date of Patent: Oct. 16, 2012

(54) ELECTROMAGNETIC CONTACTOR

(75) Inventors: Yasuhiro Naka, Kounosu (JP); Toshikatsu Ohgami, Kumagaya (JP); Koji Okubo, Kumagaya (JP); Kouetsu Takaya, Kounosu (JP); Kenji Suzuki, Minami-Saitama-gun (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/138,029

(22) PCT Filed: Jun. 14, 2010

(86) PCT No.: PCT/JP2010/003931

§ 371 (c)(1),
(2), (4) Date: Sep. 15, 2011

(87) PCT Pub. No.: WO2011/021329

PCT Pub. Date: Feb. 24, 2011

(65) Prior Publication Data

US 2012/0133462 A1 May 31, 2012

(30) Foreign Application Priority Data

Aug. 20, 2009 (JP) ..... 2009-190581

(51) Int. Cl.
*H01H 9/00* (2006.01)
*H01H 67/02* (2006.01)

(52) U.S. Cl. ..... 335/179; 335/132; 335/131

(58) Field of Classification Search ..... 335/132, 335/179

See application file for complete search history.

(56) References Cited

U.S. PATENT DOCUMENTS

| | | | | | |
|---|---|---|---|---|---|
| 2,794,882 | A | * | 6/1957 | Russell | 335/131 |
| 3,671,891 | A | * | 6/1972 | Usui et al. | 335/126 |
| 4,490,701 | A | * | 12/1984 | Dietrich et al. | 335/78 |
| 4,509,026 | A | * | 4/1985 | Matsushita | 335/85 |
| 4,947,146 | A | * | 8/1990 | Ichimura et al. | 335/131 |
| 5,014,027 | A | * | 5/1991 | Ootsuka | 333/132 |
| 5,075,660 | A | * | 12/1991 | Ootsuka | 335/131 |
| 5,081,436 | A | * | 1/1992 | Nishi et al. | 335/83 |
| 7,091,805 | B2 | * | 8/2006 | Kawahara et al. | 335/132 |

FOREIGN PATENT DOCUMENTS

| | | |
|---|---|---|
| JP | U S63-174150 | 11/1988 |
| JP | H01-315920 | 12/1989 |
| JP | H03-049125 | 3/1991 |
| JP | U H06-38144 | 5/1994 |
| JP | U H06-86245 | 12/1994 |

* cited by examiner

*Primary Examiner* — Elvin G Enad
*Assistant Examiner* — Alexander Talpalatski
(74) *Attorney, Agent, or Firm* — Manabu Kanesaka

(57) ABSTRACT

The electromagnetic contactor enables a reliable return to a pole open position without increasing the spring force of a return spring. In an electromagnetic contactor, an electromagnetic device having an exciting coil and a contact mechanism having a return spring are disposed in parallel, and the electromagnetic device and contact mechanism are linked by a drive lever. The electromagnetic device has a polarized electromagnet having a magnetic circuit that includes a permanent magnet generating a suction force that moves the contact mechanism to a pole open position side when the exciting coil is not energized. The drive lever is fixed to either one of the electromagnetic device or contact mechanism and contacts with the other with no gap at least when the contact mechanism is moved to the pole open position side. The return force of the contact mechanism is covered by the suction force of the permanent magnet.

7 Claims, 12 Drawing Sheets

ELECTROMAGNETIC CONTACTOR

RELATED APPLICATIONS

The present application is National Phase of International Application No. PCT/JP2010/003931 filed Jun. 14, 2010, and claims priority from, Japanese Application No. 2009-190581 filed Aug. 20, 2009, the disclosure of which is hereby incorporated by reference herein in its entirety.

TECHNICAL FIELD

The present invention relates to an electromagnetic contactor wherein a contact mechanism is made movable using a polarized electromagnet.

BACKGROUND ART

As this kind of electromagnetic contactor, a conventional electromagnetic contactor includes: a case, an electromagnetic device having a fixed iron core penetrating a coil frame on which a coil is wound and a movable iron core opposing the fixed iron core so as to be connectable and detachable, a contact-equipped movable frame disposed in parallel with the electromagnetic device, spring-urged in a return direction, and moving in parallel with the movable iron core, and an interlocking lever that links the movable iron core and movable frame, wherein a spring that urges the movable iron core in a pole open direction in a condition in which the movable iron core is adsorbed to the fixed iron core without contacting in a condition in which the movable iron core is not adsorbed to the fixed iron core, is provided on the coil frame (for example, refer to Patent Document 1).

RELATED ART DOCUMENTS

Patent Documents

Patent Document 1: JP-UM-6-86245

DISCLOSURE OF THE INVENTION

Problems that the Invention is to Solve

However, in the heretofore known example described in Patent Document 1, the contact-equipped movable frame is spring-urged in the return direction by a return spring. The contact-equipped movable frame is returned by the return spring when the electromagnetic device is in a non-energized condition and, by putting the electromagnetic device into an energized condition during this condition and adsorbing the movable iron core to the fixed iron core, the contact-equipped movable frame is made movable against the return spring via the interlocking lever along with the movement of the movable iron core. However, a movement in a direction opposite to the return direction of the contact-equipped movable frame is carried out by the force of adsorption of the movable iron core to the fixed iron core arising from the energization of the electromagnetic device. The contact-equipped movable frame returns up to a predetermined distance in the return direction under a combined spring force of the spring force of the return spring added to the spring force of the spring provided in the electromagnetic device, and in the end, the contact-equipped movable frame is returned to the pole open position by the spring force of the return spring.

In this case, in order to reliably return the contact movable frame to the pole open position, increasing the spring force of the return spring is necessary, and in this case, it is also necessary to increase the electromagnetic adsorption force of the electromagnetic device, meaning that there is an unsolved problem such that the configuration of the whole increases in size. In particular, as the contacts are provided urging in the contact direction by pressing springs in the contact-equipped movable frame, there is no problem when there is no b contact when the contact-equipped movable frame returns to the pole open position, but when there are a large number of b contacts, there is no option other than to increase the spring force of the return spring.

In the case of a direct current electromagnet, wherein there are a large number of b contacts making contact when the contact-equipped movable frame returns to the pole open position in this way, the relationship between the suction force and the load (the contact load) must be made such that input is applied at the suction force at a time of an optional input voltage Von, and the return to the pole open position of the release is possible at the suction force at a time of a release voltage Voff. Consequently, as shown by a polygonal line characteristic line L0 in FIG. 19, the contact load is positioned between the suction force represented by an input suction characteristic curve L1 at the time of the input voltage Von and the suction force represented by a release suction characteristic curve L2 at the time of the release voltage Voff, but when the suction force represented by the input suction characteristic curve L1 is exceeded in one portion, it is necessary to increase the margin of the tensile force generated by the electromagnet. Also, when the return as far as the pole open position is covered only by the return spring, the initial pressure of the load must always be equal to or greater than 0 (gf), so it is possible to release to the end regardless of the kind of contact configuration, and there is an unsolved problem wherein the load inevitably increases.

Therefore, bearing in mind the unsolved problems of the heretofore known example, the invention provides an electromagnetic contactor that can enable a reliable return to the pole open position without increasing the spring force of the return spring.

Means for Solving the Problems

In order to achieve the heretofore described object, in an electromagnetic contactor according to one aspect of the invention wherein an electromagnetic device having an exciting coil and a contact mechanism of a return spring are disposed in parallel, and the electromagnetic device and contact mechanism are linked by a drive lever, wherein the electromagnetic device comprises a polarized electromagnet including a magnetic circuit with a permanent magnet generating a suction force. When the exciting coil is not energized, the permanent magnet moves the contact mechanism to a pole open position side, the drive lever is fixed to either one of the electromagnetic device or contact mechanism, and is brought into contact with the other with no gap at least when the contact mechanism is moved to the pole open position side, and the return force of the contact mechanism in the vicinity of the pole open position is covered by the suction force of the permanent magnet.

According to this configuration, when returning the contact mechanism to the pole open position, the return to the pole open position is started by the spring force of the return spring when starting the return, and in the end, the contact mechanism is returned to the pole open position by using the suction force of the permanent magnet, which means that the return to the pole open position can be reliably carried out and also, it is possible to reduce the spring force of the return spring.

Also, the electromagnetic contactor according to another aspect of the invention is characterized in that the drive lever is fixed to the electromagnetic device, and the free end of the drive lever is brought into contact with a movable contact support urged to the pole open position side by the return spring configuring the contact mechanism with no gap in either direction in which the movable contact support can move.

According to this configuration, as the drive lever is fixed to either one of the electromagnetic device or contact mechanism, and the free end of the drive lever is brought into contact with the other of the electromagnetic device or contact mechanism, with no gap in either direction in which the movable contact support can move, it is possible to reliably transmit a drive force caused by the suction force of the permanent magnet of the electromagnetic device to the movable contact support via the drive lever.

Furthermore, in the electromagnetic contactor according to another aspect of the invention, the drive lever is fixed to the electromagnetic device, and an arc portion that contacts with the end surface of the movable contact support on the side opposite to that of the return spring is formed in the free end thereof, distanced a predetermined distance inward from the leading end. A lever retainer portion formed on the movable contact support contacts with the side opposite to the end surface of the outer side leading end portion of the arc portion.

According to this configuration, as the free end of the drive lever is inserted between and supported by the end face of the movable contact support and the lever retainer portion, it is possible to reliably bring the drive lever and movable contact support into contact with no gap in either direction in which the movable contact support can move.

Further still, the electromagnetic contactor according to another aspect of the invention is characterized in that the lever retainer portion is flexible, and presses against the drive lever.

According to this configuration, as the lever retainer portion is flexible, and presses against the drive lever, it is possible to support the free end of the drive lever while applying a predetermined contact pressure, to prevent a gap from occurring, and to maintain the position without any rattling.

Advantage of the Invention

According to the invention, in an electromagnetic contactor in which an electromagnetic device having an exciting coil and a contact mechanism having a return spring are disposed in parallel, and the electromagnetic device and contact mechanism are linked by a drive lever, the drive lever is fixed to either one of the electromagnetic device or contact mechanism, and contacts with the other with no gap at least when the contact mechanism is moved to the pole open position side, and the return force of the contact mechanism in the vicinity of the pole open position is covered by the suction force of the permanent magnet. Therefore, it is possible to reliably carry out the return to the pole open position, because the spring force of the return spring is unnecessary in the vicinity of the pole open position, advantages are obtained in that it is possible to reduce the spring force of the return spring by this amount, to reduce the electromagnetic force generated in the electromagnetic device, and to downsize the configuration of the whole.

MODE FOR CARRYING OUT THE INVENTION

Hereafter, a description will be given based on the drawings of an embodiment of the invention.

Figure 1:
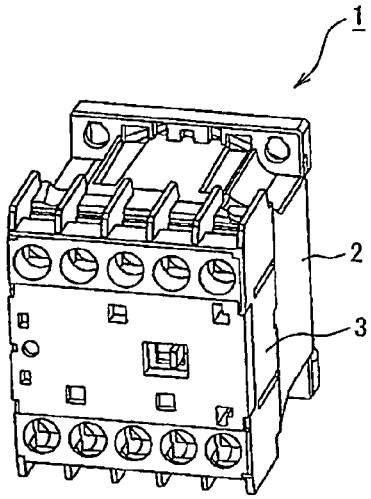
FIG. 1 is a perspective view showing one embodiment when applying the invention to an electromagnetic contactor.
Figure 2:
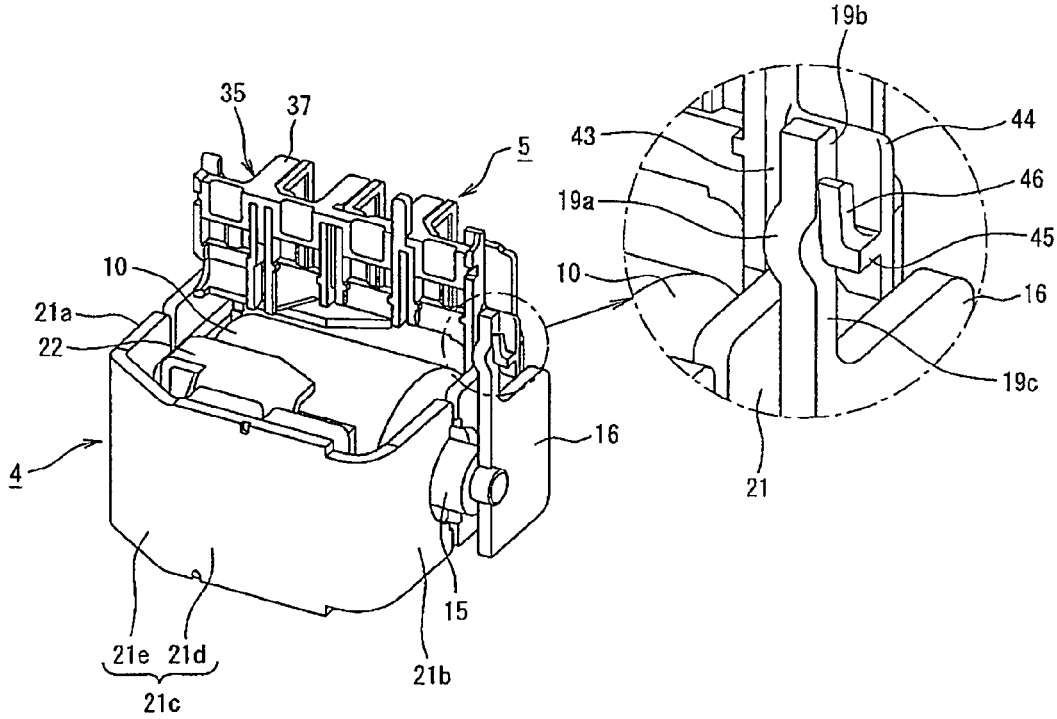
FIG. 2 is a perspective view showing a polarized electromagnet that causes the contact mechanism to slide and an enlarged view of a section of a main portion of a contact mechanism installed inside the electromagnetic contactor.

In FIG. 1, numeral 1 is an electromagnetic contactor, and the electromagnetic contactor 1 has a lower case 2 and an upper case 3, each of which is formed of a synthetic resin material having insulation. A polarized electromagnet 4 configuring a direct current operated type of electromagnetic device is installed inside the lower case 2, as shown in FIG. 3, and a contact mechanism 5 shown in FIG. 2 is installed inside the upper case 3.

Figure 3:
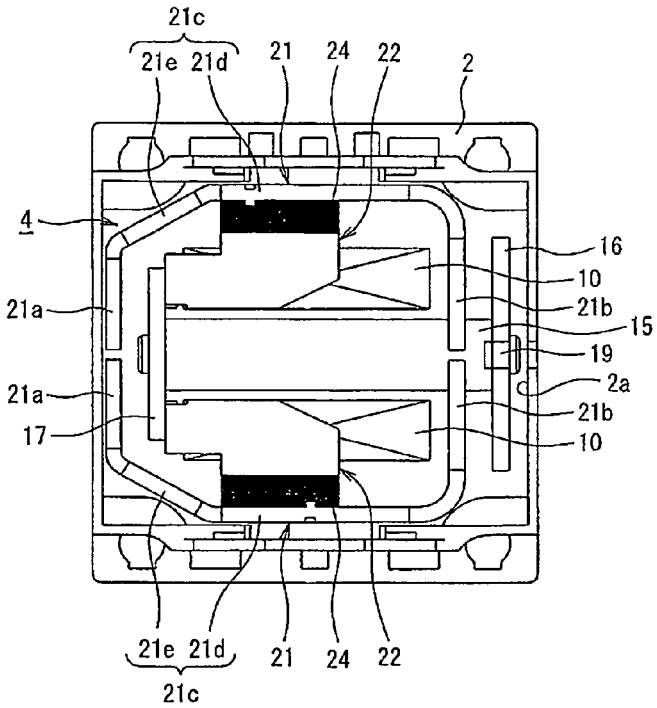
FIG. 3 is a schematic plan view of a lower case housing the polarized electromagnet.
Figure 4:
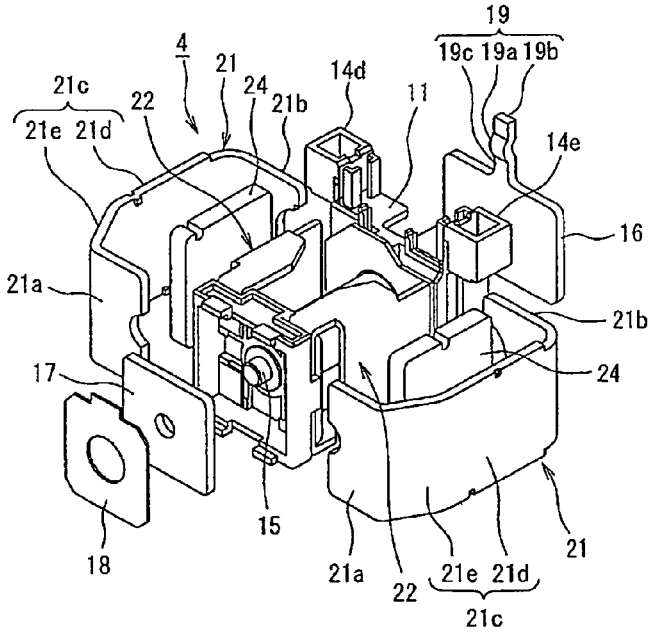
FIG. 4 is an exploded perspective view of the polarized electromagnet.
Figure 5:
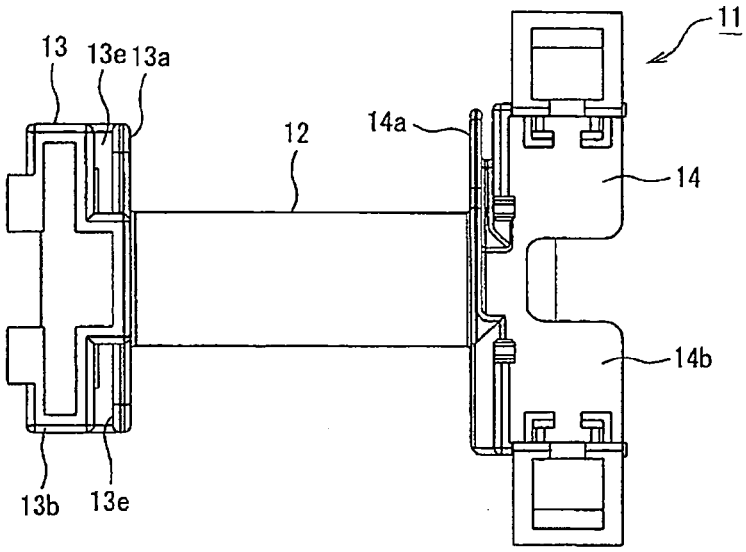
FIG. 5 is a plan view showing a spool.
Figure 6:
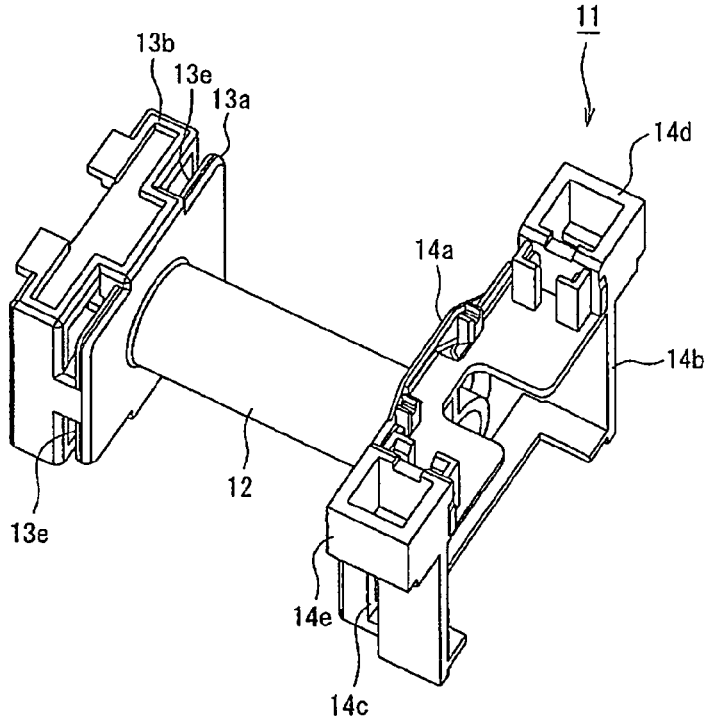
FIG. 6 is a perspective view of the spool shown from an upper right direction.
Figure 7:
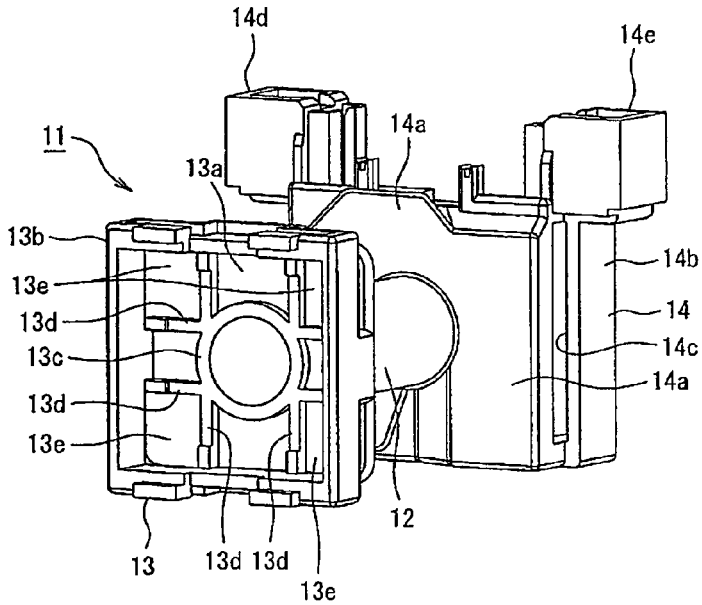
FIG. 7 is a perspective view of the spool shown from a left side direction.
Figure 8:
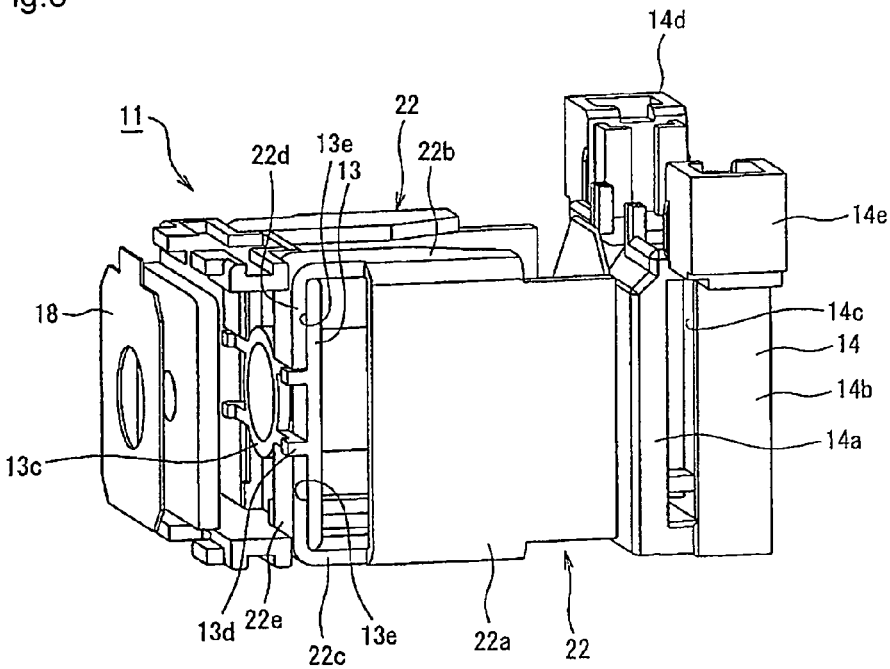
FIG. 8 is a perspective view showing a left end side of the polarized electromagnet.
Figure 9:
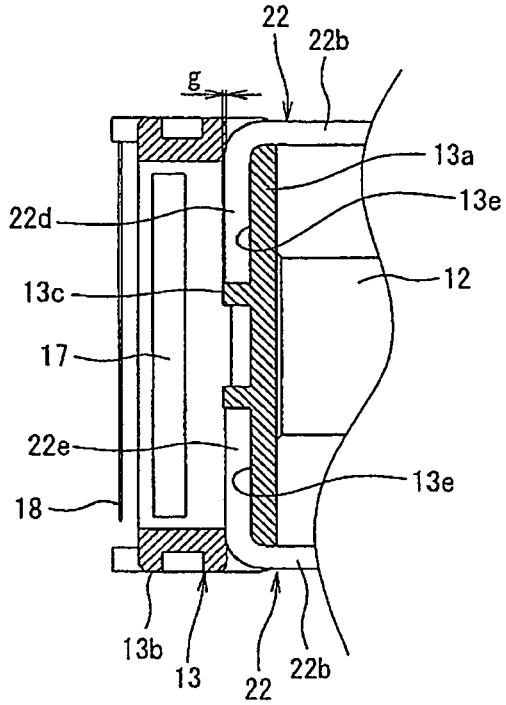
FIG. 9 is an enlarged cross-sectional view showing a condition in which an interior yoke is attached to the spool.

The polarized electromagnet 4, as shown in FIG. 3 and FIG. 4, has a spool 11 around which is wound an exciting coil 10 configuring an electromagnet. The spool 11, as shown in FIG. 5 to FIG. 8, is configured of a cylindrical portion 12, and left and right flange portions 13, 14 formed integrally at either end of the cylindrical portion 12. The left flange portion 13 is configured of a rectangular coil retainer plate 13*a* that restricts an end portion of the exciting coil 10, and a rectangular frame-like armature housing portion 13*b* attached to the outer side of the coil retainer plate 13*a* in a central position on each side. A ring-like projection 13*c* as a projection for positioning with respect to the cylindrical portion 12, and a lattice-form projection 13*d* extending outward from the ring-like projection 13*c*, are formed protruding on the outer surface of the coil retainer plate 13*a*, as shown in FIG. 7.

Herein, yoke holding portions 13*e* in which are inserted and held second opposing plate portions 22*d* and 22*e* of interior yokes 22, to be described hereafter, are formed in the four corners partitioned off by the lattice-form projection 13*d*.

The right flange portion 14 has a rectangular coil retainer plate 14*a* that restricts an end portion of the exciting coil 10, and a rectangular frame-like armature housing portion 14*b* attached to the outer side of the coil retainer plate 14*a* by the outer peripheral side thereof. Yoke holding portions 14*c* in which are inserted and held end plate portions 21*b* of exterior yokes 21, to be described hereafter, and coil terminal portions 14*d* and 14*e* in which are tied coil start and coil finish end portions of the exciting coil 10, are formed on the armature housing portion 14*b*.

Figure 11:
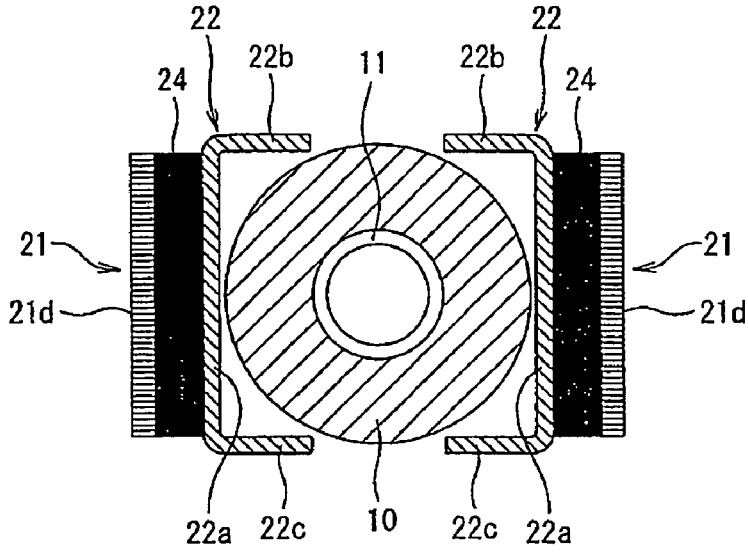
FIG. 11 is a cross-sectional view in a direction perpendicular to the axial direction of the polarized electromagnet.

Then, the exciting coil 10 is wound between the cylindrical portion 12 of the spool 11 and the coil retainer plates 13*a*, 14*a* of the left and right flange portions 13, 14, as shown in FIG. 3 and FIG. 11.

Also, a plunger 15 held movably inside penetrates the cylindrical portion 12 of the spool 11. A first armature 16 is fixed in the corresponding end portion inside the armature housing portion 14*b* formed in the right flange portion 14 of the spool 11 at the right end of the plunger 15. Also, a second armature 17 is fixed in the corresponding position inside the armature housing portion 13*b* formed in the left flange portion 13 of the spool at the left end of the plunger 15, and a non-magnetic plate 18 is disposed on the outer side of the second armature 17. Then, a drive lever 19 linked to a movable contact support 37 of a movable contact portion 35 of the contact mechanism 5, which drives the movable contact support 37 in left and right directions, is disposed on the upper surface of the first armature 16. The drive lever 19 is integrally formed on the upper surface of the first armature 16 in a square rod form as shown enlarged in FIG. 2. The drive lever 19 is such that a curved bulging portion 19*a* bulging to the left is formed in an approximately central position in an up-down direction, down a predetermined distance from the leading end of the free end, and vertical rod portions 19*b* and 19*c* are formed sandwiching the curved bulging portion 19*a* above and below.

Furthermore, an axisymmetrical front and back pair of exterior yokes 21 sandwiching the spool 11, guided into and fixed inside a housing portion 2*a* formed in the lower case 2, are disposed in the right flange portion 14 of the spool 11. Also, an axisymmetrical front and back pair of interior yokes 22 sandwiching the spool 11, maintaining a predetermined distance from the exterior yokes 21, are disposed in the left flange portion 13 of the spool 11.

Figure 10:
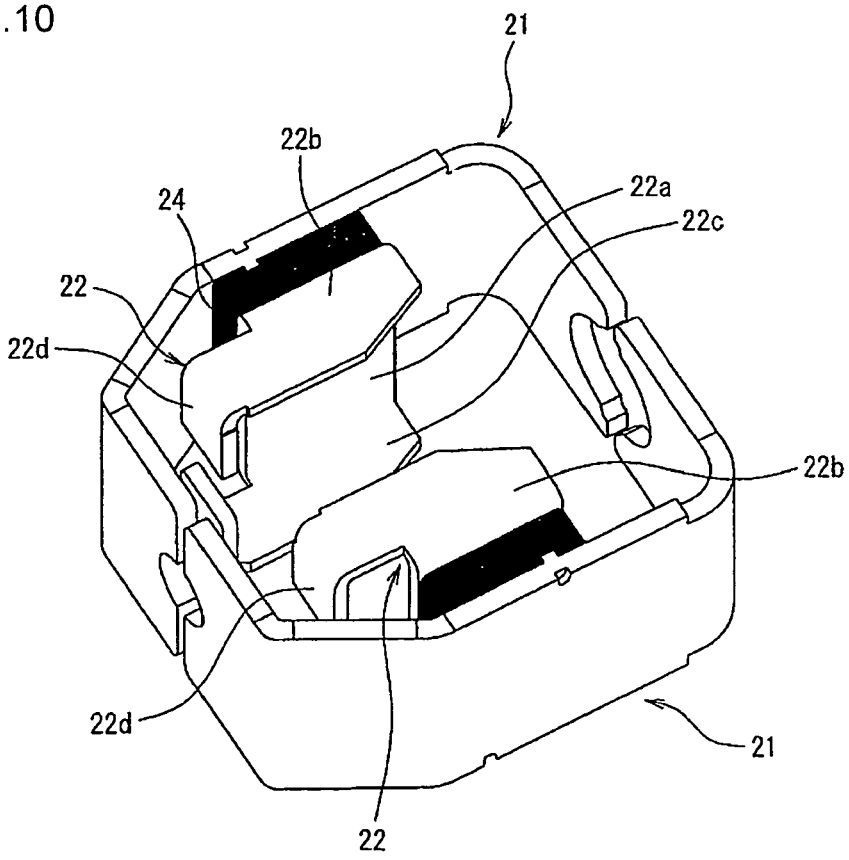
FIG. 10 is a perspective view showing the polarized electromagnet in a condition in which the spool is removed.

The exterior yoke 21, as is particularly clear in FIGS. 3, 4, and 10, is formed in an approximately C-channel form seen from above of a left end plate portion 21*a* opposing the left flange portion 13 of the spool 11 and distanced therefrom by a predetermined interval, a right end plate portion 21*b* inserted in the right flange portion 14 of the spool 11, and a linking plate portion 21*c* that links the left and right end plate portions 21*a* and 21*b*. The linking plate portion 21*c* is formed of a flat plate portion 21*d* that links with the right end plate portion 21*b*, extending in the tangential direction of the exciting coil wound around the spool 11, and an inclined plate portion 21*e* formed on the opposite side of the flat plate portion 21*d* to the right end plate portion 21*b* that inclines inward as it goes to the left end; and the left end plate portion 21*a* is linked to the left end portion of the inclined plate portion 21*e*.

Figure 12:
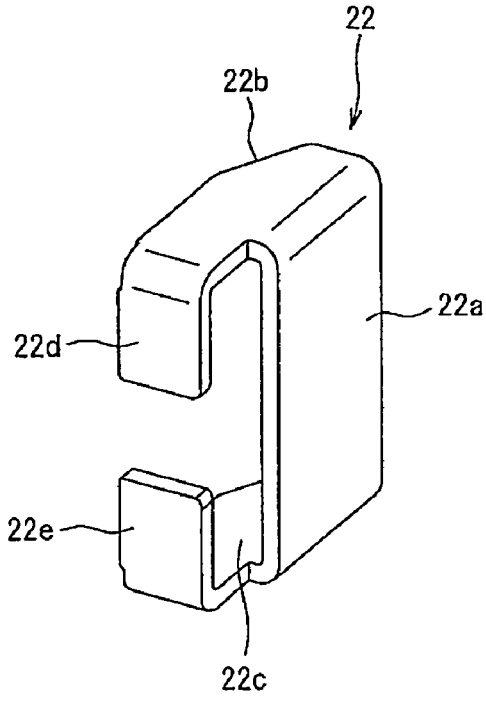
FIG. 12 is a perspective view showing the interior yoke.

Meanwhile, the interior yoke 22, as is particularly clear in FIGS. 11 and 12, has a first opposing plate portion 22*a* that opposes the flat plate portion 21*d* of the exterior yoke 21, and bent portions 22*b*, 22*c* extending inward and joined to upper and lower end portions of the first opposing plate portion 22*a* in the tangential direction of the exciting coil 10 wound around the spool 11. Then, second opposing plate portions 22*d* and 22*e* formed bent inwardly are formed on the leading end side protruding beyond the first opposing plate portion 22*a* at the leading ends of the bent portions 22*b* and 22*c*. Then, the second opposing plate portions 22*d* and 22*e* of the interior yoke 22 are inserted in and held by the yoke holding portions 13*e* of the left flange portion 13 of the spool 11, and are opposed by the left end plate portion 21*a* of the exterior yoke 21.

Also, the first armature 16 is disposed on the outer side of the right end plate portion 21*b*, of the exterior yoke 21, and the second armature 17 is disposed between the left end plate portion 21*a* of the exterior yoke 21 and the second opposing plate portions 22*d* and 22*e* of the interior yoke 22.

Furthermore, a permanent magnet 24 is disposed between the flat plate portion 21*d* of the exterior yoke 21 and the first opposing plate portion 22*a* of the interior yoke 22.

Figure 13:
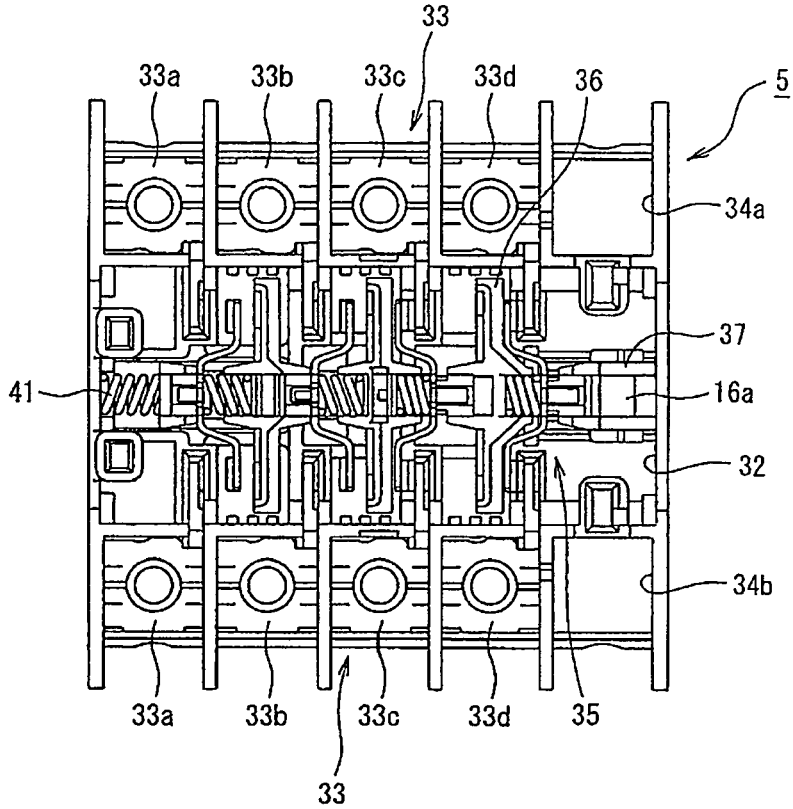
FIG. 13 is a plan view showing the contact mechanism.
Figure 14:
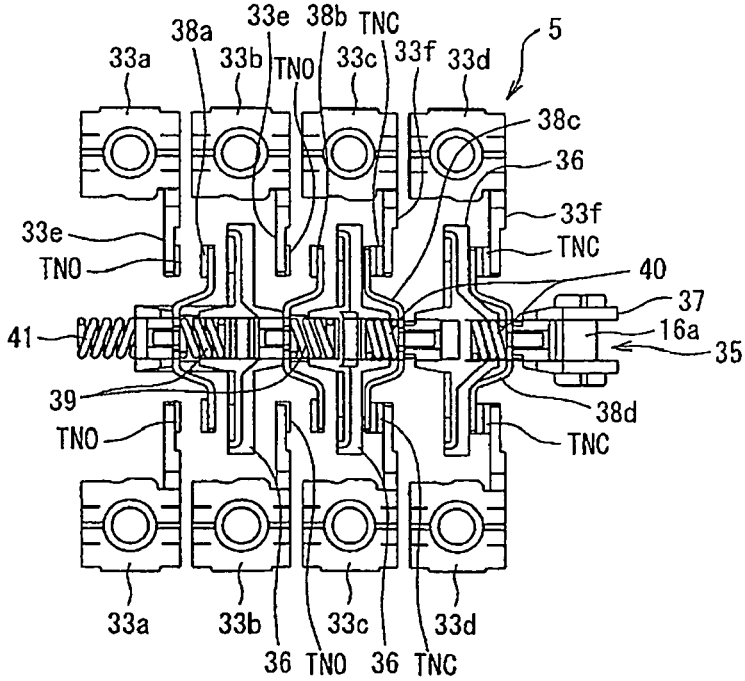
FIG. 14 is a plan view showing a movable contact portion of the contact mechanism.

The contact mechanism 5, as shown in FIG. 13 and FIG. 14, includes a movable contact housing portion 32 extending in the left-right direction formed in a central portion in the front-back direction of the upper case 3, main circuit terminal portions 33 disposed symmetrically front and back sandwiching the movable contact housing portion 32, and terminal insertion portions 34*a*, 34*b* inserted and held in the coil terminal portions 14*d* and 14*e* of the polarized electromagnet 4.

Each of the main circuit terminal portions 33 has main circuit terminals 33*a* to 33*d*, as shown in FIG. 14, each of the main circuit terminals 33*a* and 33*b* has a contact piece 33*e* protruding inward into the movable contact housing portion 32 from the interior right end side, and a fixed contact TNO is formed on the leading end right side surface of the contact piece 33*e*. Also, each of the main circuit terminals 33*c* and 33*d* has a contact piece 33*f* protruding inwardly into the movable contact housing portion 32 from the interior right end, and a fixed contact TNC is formed on the leading end left side surface of the contact piece 33*f*.

Then, the movable contact portion 35 is disposed slidably in the left-right direction in the movable contact housing portion 32. The movable contact portion 35 has the movable contact support 37, which are formed with partition walls 36 maintaining predetermined intervals made of a synthetic resin material, and movable contacts 38*a* to 38*d* supported by the partition walls 36 of the movable contact support 37. Herein, the movable contacts 38*a*, 38*b* oppose the fixed contacts TNO of the main circuit terminals 33*a*, 33*b* respectively, and are urged by contact springs 39 in a direction away from the partition walls 36 to the left. Also, the movable contacts 38*c*, 38*d* oppose the fixed contacts TNC of the main circuit terminals 33*c*, 33*d* respectively, and are urged by contact springs 40 in a direction away from the partition walls 36 to the right.

Then, the movable contact support 37 is urged to the right by a return spring 41. The return spring 41 disposed in such a way that one end penetrates a left end plate portion 37*a* and contacts with the partition wall 36, and the other end contacts with the upper case side wall interior surface, is set to attain a free length in the vicinity of a pole open position at which is attained a condition wherein the movable contacts 38*c*, 38*d* formed on the movable contact support 37 contact with the fixed contacts TNC, and are pressed with a predetermined pressure by the contact springs 40.

Figure 15:
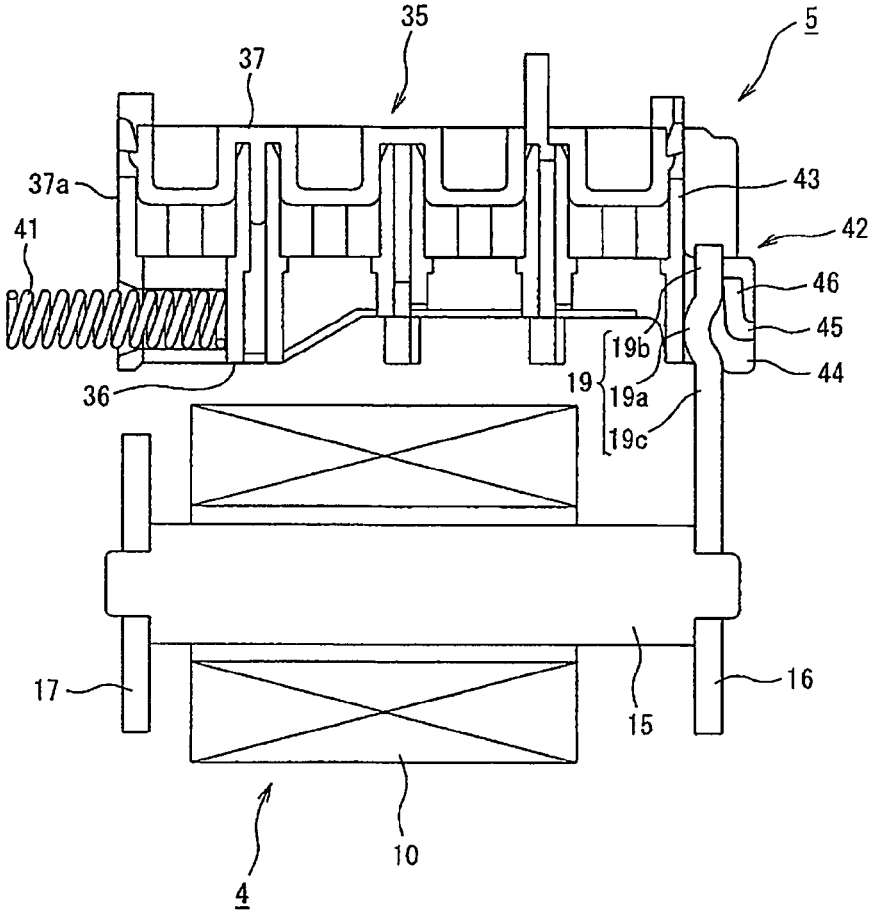
FIG. 15 is a schematic view showing a link relationship between the polarized electromagnet and the contact mechanism.

Also, a linking portion 42, which is linked to the drive lever 19 formed on the first armature 16 of the polarized electromagnet 4, is formed on the right end of the movable contact support 37. As shown in FIG. 15 as well as being shown enlarged in FIG. 2, the linking portion 42 is configured of a pair of support plate portions formed protruding to the right maintaining a predetermined interval in the front-back direction formed on a right end plate portion 43 of the movable contact support 37, a linking plate portion 45 that links the right ends of the support plate portions 44, and a flexible lever retainer portion 46 extending diagonally left and upward from the linking plate portion 45. The distance between the leading end of the lever retainer portion 46 and the right end surface of the right end plate portion 43 is set to be slightly smaller than the distance between the right end surface of the drive lever 19 and the apex of the curved bulging portion 19*a*.

Consequently, when the upper case 3 holding the contact mechanism 5 is attached to the lower case 2 holding the polarized electromagnet 4, the drive lever 19 and movable contact support 37 are linked. The linking of the drive lever 19 is carried out by inserting the drive lever 19 from below into a lever housing space surrounded by the right end surface of the right end plate portion 43 of the movable contact support 37, the pair of support plate portions 44, and the lever retainer portion 46. When inserting the drive lever 19 from below into the lever housing space in this way, the apex of the curved bulging portion 19*a* of the drive lever 19 contacts with the right end surface of the right end plate portion 43, the lever retainer portion 46 presses against the right end surface of the upper end side vertical rod portion 19*b*, and the drive lever 19 is press-fitted and tightly held without leaving any gap in the left-right direction, that is, in either direction in which the movable contact support 37 can move.

Next, a description will be given of actions of the heretofore described embodiment.

Figure 16:
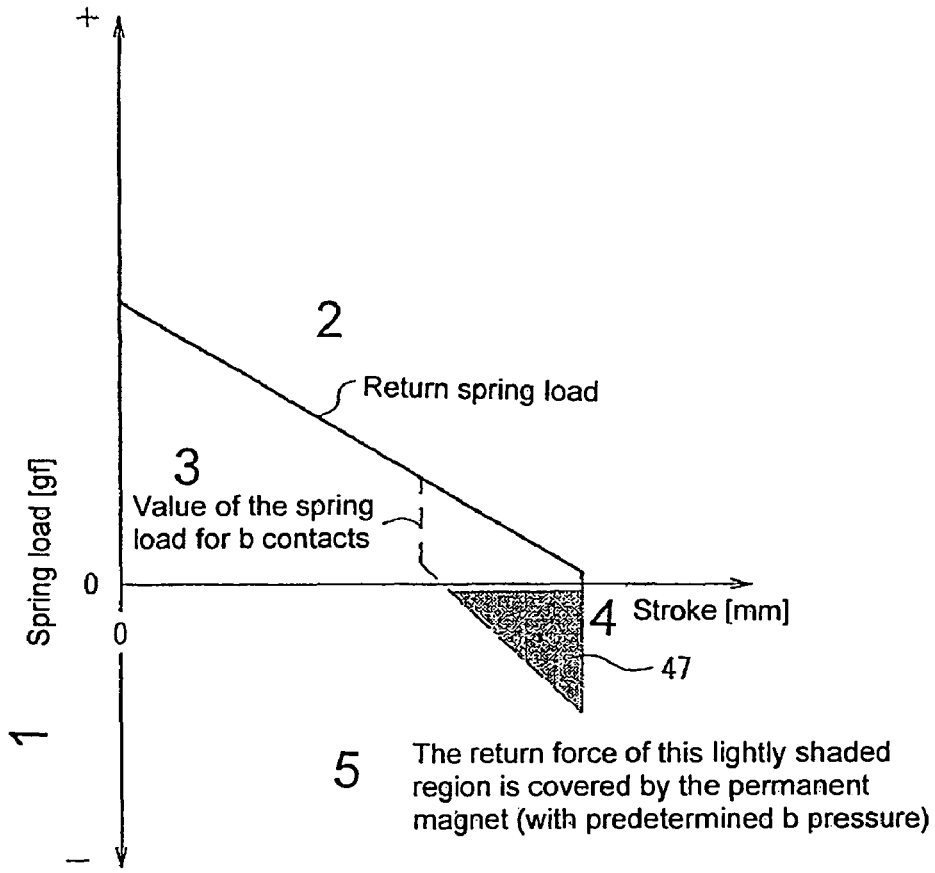
FIG. 16 is a characteristic line diagram showing a relationship between stroke and spring load in the vicinity of a pole open position of the invention.

Now, in a condition in which the coil terminal portions 14*d* and 14*e* are not energized, the exciting coil 10 is in a non-excited condition, and no drive force to drive the plunger 15 is emitted. However, in the contact mechanism 5, the movable contact support 37 is urged to the right by the return spring 41. Therefore, the movable contact support 37 with the movable contacts 38*c*, 38*d* thereof contacting with the fixed contacts TNC further compresses the contact springs 40. At this time, the return spring 41 is set in such a way that the return spring 41 attains a free length in the vicinity of a pole open position which will attain a condition wherein the movable contact support 37 moves to the right, compressing the contact springs 40, and the movable contacts 38*c*, 38*d* contacts with the fixed contacts TNC with a predetermined pressure. For this reason, until the movable contact support 37 moves to the right because of the return spring 41, the movable contacts 38*c*, 38*d* contacts with the fixed contacts TNC, and the two contact springs 40 are compressed, the movable contact support 37 is moved smoothly to the right by the spring load of the return spring 41. However, as shown in FIG. 16, immediately before reaching the pole open position, the spring load of the return spring 41 coincides with the spring loads of the two contact springs 40 indicated by the broken line, and it is not possible to carry out any further compression of the contact springs 40.

Meanwhile, at the polarized electromagnet 4, by the magnetic force of the permanent magnet 24 being transmitted to the second opposing plate portions 22*d* and 22*e* via the interior yoke 22, the second armature 17 is suctioned by the second opposing plate portions 22*d*, 22*e* either immediately before the compression of the contact springs 40 by the return spring 41 becomes impossible, or before that, before the pole open position. As a result of this, the return force of a lightly shaded region 47 of FIG. 16 is covered by the permanent magnet 24. Consequently, the contact springs 40 are compressed by the suction force of the permanent magnet 24, and the movable contact support 37 is reliably returned to the pole open position at which the movable contacts 38*c* and 38*d* contact with the fixed contacts TNC with a predetermined pressure. At this time, as previously described, the leading end of the drive lever 19 formed integrally with the first armature 16 is press-fitted and held tightly in the linking portion 42 formed on the movable contact support 37 of the contact mechanism 5. For this reason, the suction force acting on the second armature 17 emitted by the permanent magnet 24 is transmitted without loss to the movable contact support 37 via the plunger 15, first armature 16, and drive lever 19. Because of this, the movable contact support 37 is reliably returned to the pole open position. At the pole open position, the movable contacts 38*a*, 38*b* are detached from the fixed contacts TNO of the main circuit terminals 33*a*, 33*b*.

From the condition in which the movable contact portion 35 of the contact mechanism 5 is in the pole open position, the exciting coil 10 is excited to an opposite polarity of the permanent magnet 24 by energizing the coil terminal portions 14*d*, 14*e*. Because of this, a suction force acts between the left and right armatures 17, 16 and the left and right end plate portions 21*a*, 21*b* of the exterior yoke 21. At the same time as this, a repulsion force acts between the left side armature 17 and the second opposing plate portions 22*d*, 22*e* of the interior yoke 22. Because of this, the plunger 15 moves to the left against the spring force of the return spring 41, and the armatures 17, 16 are adsorbed to the left and right end plate portions 21*a*, 21*b* of the exterior yoke 21. Because of this, the movable contact support 37 of the movable contact portion 35 moves to the left against the return spring 41 via the drive lever 19 of the first armature 16, and attains a pole closed position at which the movable contacts 38*a*, 38*b* contact with the fixed contacts TNO of the main circuit terminals 33*a*, 33*b* with a predetermined pressing force of the contact springs 39. By the movable contact support 37 moving to the left, the movable contacts 38*c* and 38*d* are detached from the fixed contacts TNC of the main circuit terminals 33*c* and 33*d*.

Also, when the energization of the coil terminal portions 14*d* and 14*e* is stopped in the condition in which the contact mechanism 5 is in the pole closed position, the exciting coil 10 returns to the non-excited condition, the second armature 17 is suctioned by the pressing force of the return spring 41 and the suction force of the second opposing plate portions 22*d* and 22*e* of the interior yoke 22 caused by the permanent magnet 24, and the movable contact support 37 of the movable contact portion 35 returns to the heretofore described pole open position.

At this time, with the polarized electromagnet 4, a magnetic flux from the permanent magnet 24 is such that, for example, the interior yoke 22 side is the N pole and the exterior yoke 21 side is the S pole, a flux path is formed wherein a magnetic flux emitted from the N pole reaches the second opposing plate portions 22*d* and 22*e*, via the bent portions 22*b* and 22*c*, from the first opposing plate portion 22*a* of the interior yoke 22, passes from the second opposing plate portions 22*d* and 22*e* through the left end plate portion 21*a*, inclined plate portion 21*e*, and flat plate portion 21*d* of the exterior yoke 21, and reaches the S pole of the permanent magnet 24.

At this time, as shown in FIG. 3, there is hardly any place in which the exterior yoke 21 and interior yoke 22 approach and oppose each other, and the left end plate portion 21*a* of the exterior yoke 21 and second opposing plate portions 22*d*, 22*e* of the interior yoke 22, which need suction force, approach and oppose each other. For this reason, by the space between the exterior yoke 21 and interior yoke 22 narrowing, it is possible to reduce the leakage magnetic flux and increase the suction force at the second opposing plate portions 22*d* and 22*e* of the interior yoke 22 without a magnetic flux leakage portion being formed.

Moreover, as the second opposing plate portions 22*d*, 22*e* of the interior yoke 22 are linked to the first opposing plate portion 22*a*, which contacts with the permanent magnet 24, via the bent portions 22*b* and 22*c*, it is possible to dispose the bent portions 22*b*, 22*c* utilizing the dead space at the four corners on the outer peripheral side of the cylindrical exciting coil 10, as shown in FIG. 11. Therefore, it is possible to leave the external form of the interior yoke 22 as it is in the heretofore known example and to avoid increasing the size of the whole configuration.

Figure 17:
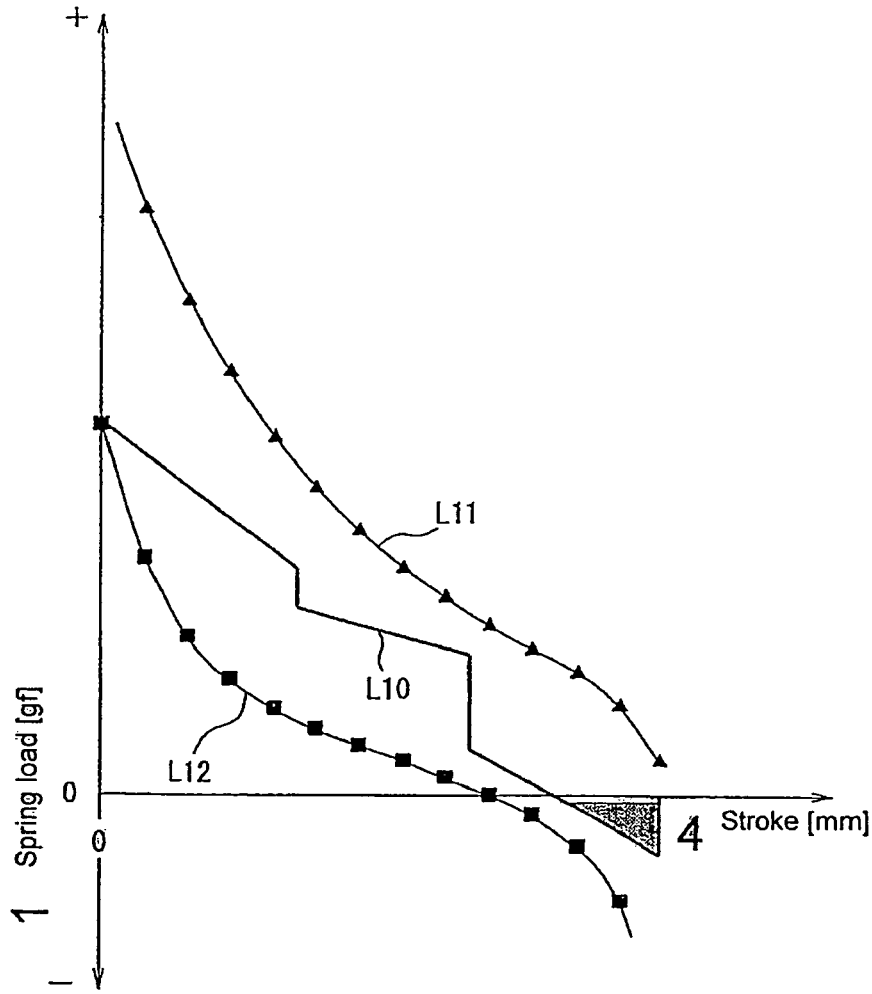
FIG. 17 is a characteristic line diagram showing a relationship between stroke and spring load of the invention.

As heretofore described, in the embodiment, as the spring load of the return spring 41 in the vicinity of the pole open position is kept to a low value, and the force compressing the contact springs 40 is covered by the suction force of the permanent magnet 24, for example, the relationship between the stroke and spring load of the movable contact support 37 when connecting an auxiliary contact having four b contacts to the heretofore described configuration, making the contacts 2*a*2*b*+4*b*, is as a characteristic line L10 indicated by the polygonal line in FIG. 17.

In FIG. 17, an input suction characteristic curve L11 when a direct current voltage is applied to the exciting coil 10 (a time of an input voltage Von) and a release suction characteristic curve L12 at a time of a release voltage Voff are described, the contact load represented by the polygonal line form characteristic line L10 is within the range of the suction force of the input suction characteristic curve L11 and the suction force of the release suction characteristic curve L12, and it is proved that it is possible to obtain preferable action characteristics even when the initial spring load of the return spring 41 is reduced.

Figure 18:
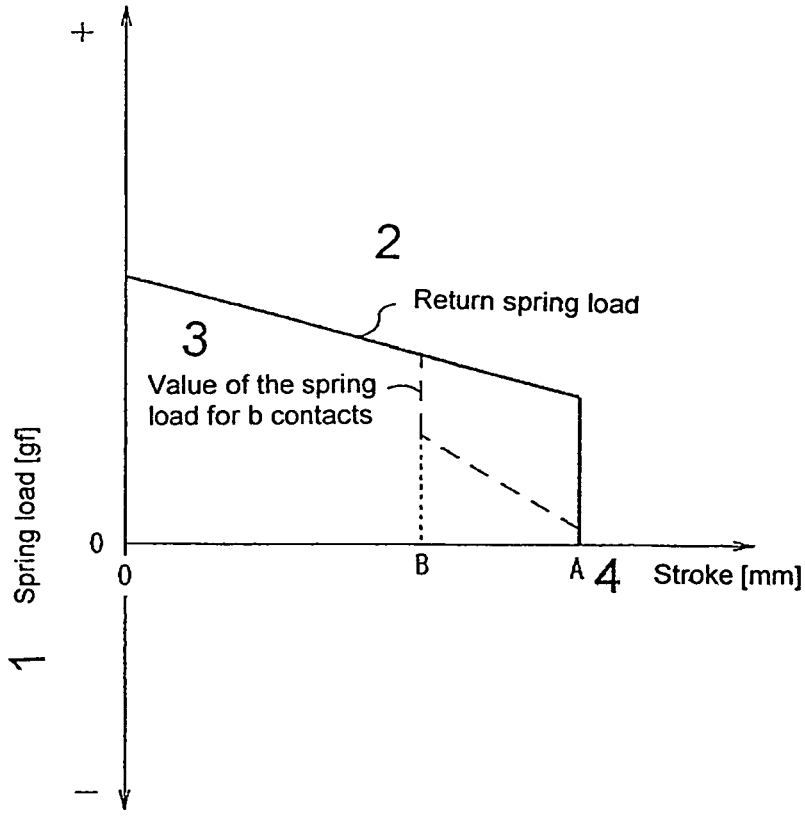
FIG. 18 is a characteristic line diagram showing a relationship between stroke and spring load in the vicinity of a pole open position of a heretofore known example.

Incidentally, in a heretofore known configuration, wherein a linking plate portion 45 and lever retainer portion 46 in a linking portion 42 of a movable contact support 37 are omitted, and the return of the movable contact support 37 to the pole open position is covered by a return spring 41 alone without utilizing the suction force of a permanent magnet 24, it is necessary to set the spring load of the return spring 41 at strokes point A and point B to a value exceeding the spring load of contact springs for b contacts as shown in FIG. 18.

Figure 19:
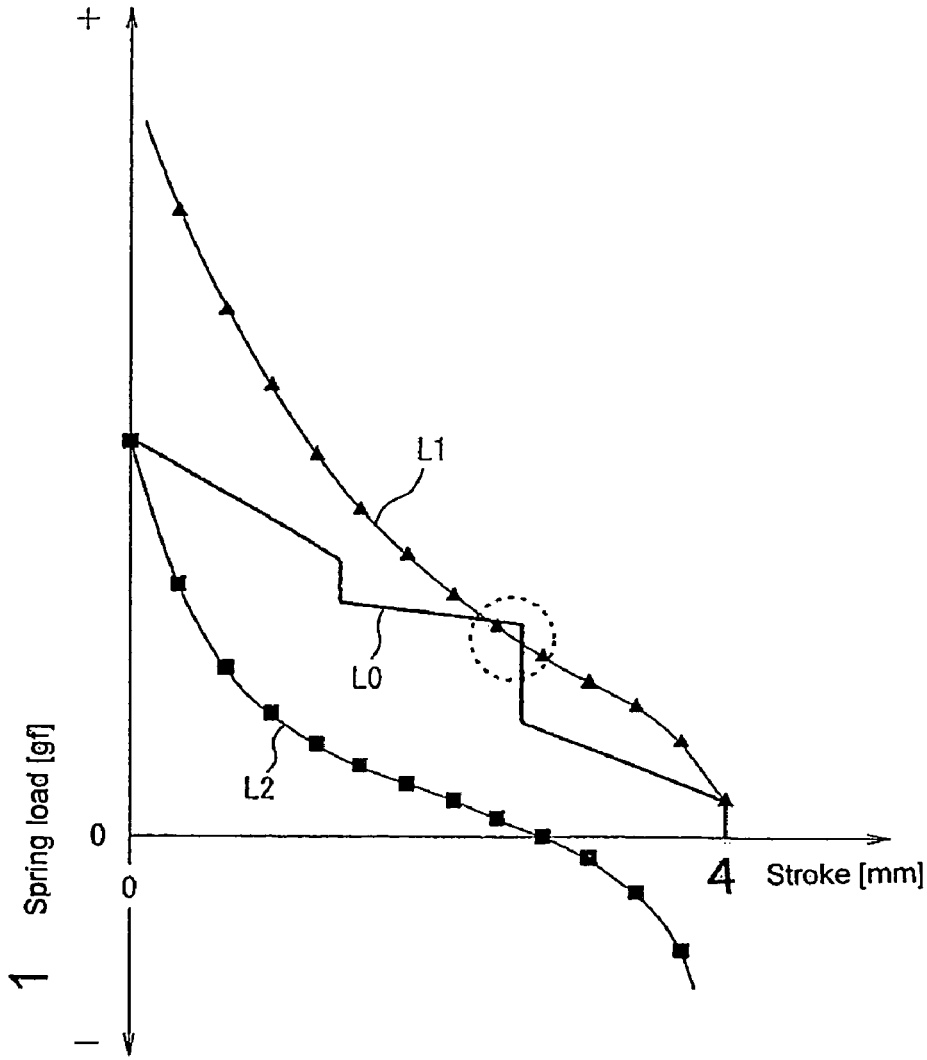
FIG. 19 is a characteristic line diagram showing a relationship between stroke and spring load accompanying a description of the heretofore known example.

For this reason, when making the contact configuration 2*a*2*b*+4*b*, the relationship between the stroke and spring load is as shown by a polygonal line characteristic line L0 in the heretofore described FIG. 19. As is clear from FIG. 19, the spring load represented by the characteristic line L0 when movable contacts 38*c* and 38*d* begin to contact with fixed contacts TNC exceeds the absorption power of an input suction characteristic curve L1, as shown by the dotted line circle, it is necessary to increase the tensile force generated by an electromagnet, and as it is necessary to increase the number of turns of the exciting coil 10 in order to do this, there is a problem in that the configuration of the whole increases in size.

In response to this, in the embodiment, as the spring force of the return spring 41 is reduced by utilizing the suction force of the permanent magnet 24, as heretofore described, the spring load represented by the characteristic line L10 does not exceed the suction force represented by the input suction characteristic curve L11. Therefore, it is possible to keep the spring load sufficiently lower than the suction force of the input suction characteristic curve L11, as shown in FIG. 17, and to downsize the configuration of the whole.

In the heretofore described embodiment, a description is given of a case in which the exterior yoke 21 configuring the polarized electromagnet 4 such that the linking plate portion 21*c* linking the left and right end plate portions 21*a* and 21*b* is configured of the flat plate portion 21*d* and inclined plate portion 21*e*, but not being limited to this, it is possible to apply an exterior yoke with an optional configuration, and in the case of the polarized electromagnet itself, it is also possible to apply a polarized electromagnet with an optional configuration.

Also, in the heretofore described embodiment, a description is given of a case in which the drive lever 19 is press-fitted and tightly held in the linking portion 42 of the movable contact support 37, but not being limited to this, the lever retainer portion 46 of the linking portion 42 may be omitted, an engagement portion that contacts with the right end surface of the drive lever 19 is formed on the linking portion 42 in such a way that at least the suction force of the permanent magnet 24 is transmitted to the movable contact support 37, and the drive lever 19 contacts and held by the linking portion 42 with no gap.

Also, in the heretofore described embodiment, a description is given of a case in which the movable contact portion 35 has two of the each, open contacts and closed contacts, but not being limited to this, it is possible to adopt a three phase, four line type of R-phase, S-phase, T-phase, or N-phase contact configuration, or another optional contact configuration.

INDUSTRIAL APPLICABILITY

According to the invention, when returning the contact mechanism to the pole open position, the return to the pole open position is started by the spring force of the return spring when starting the return, and in the end, the contact mechanism is also returned to the pole open position by using the suction force of the permanent magnet. Therefore, the return to the pole open position can be reliably carried out, and it is possible to provide an electromagnetic contactor, which reduces the spring force of the return spring.

DESCRIPTION OF REFERENCE NUMERALS AND SIGNS

1 . . . electromagnet contactor, 2 . . . lower case, 3 . . . upper case, 4 . . . polarized electromagnet, 5 . . . contact mechanism, 10 . . . exciting coil, 11 . . . spool, 15 . . . plunger, 16 . . . first armature, 16*a* . . . drive lever, 17 . . . second armature, 21 . . . exterior yoke, 22 . . . interior yoke, 24 . . . permanent magnet, 32 . . . movable contact housing portion, 33 . . . main circuit terminal portion, 35 . . . movable contact portion, 37 . . . movable contact support, 40 . . . contact spring, 41 . . . return spring, 42 . . . linking portion, 43 . . . right end plate portion, 44 . . . support plate portion, 45 . . . linking plate portion, 46 . . . lever retainer portion, 51*a* . . . first opposing plate portion, 51*b*, 51*c* . . . second opposing plate portion

What is claimed is:

1. An electromagnetic contactor, comprising:

an electromagnetic device having an exciting coil, a contact mechanism disposed parallel to the electromagnetic device, and having a movable contact support, a return spring urging the movable contact support in one direction, a contact spring urging the movable contact support in a direction opposite to the one direction, a movable contact attached to the movable contact support, and a fixed contact, and a drive lever linking the electromagnetic device and the contact mechanism;

wherein the electromagnetic device has a polarized electromagnet having a magnetic circuit that includes a permanent magnet generating a suction force that moves the movable contact support to a pole open position side when the exciting coil is not energized;

the drive lever is fixed to either one of the electromagnetic device or contact mechanism, and contacts with the other with no gap at least when the movable contact support is moved to the pole open position side; and the return spring and the contact spring direct act on the movable contact support and are arranged so that when the exciting coil is not actuated, the return spring urges the movable contact to move close to the fixed contact without contact thereto against a force of the contact spring, and a return force of the contact mechanism in a vicinity of the pole open position is made by the suction force of the permanent magnet to thereby move the movable contact to contact with the fixed contact.

2. An electromagnetic contactor according to claim 1, wherein the drive lever is fixed to the electromagnetic device, and a free end of the drive lever contacts with the movable contact support urged to a pole open position side by the return spring forming the contact mechanism with no gap in either direction in which the movable contact support can move.

3. An electromagnetic contactor, wherein an electromagnetic device having an exciting coil and a contact mechanism having a return spring are disposed in parallel, and the electromagnetic device and the contact mechanism are linked by a drive lever;

the electromagnetic device has a polarized electromagnet having a magnetic circuit that includes a permanent magnet generating a suction force that moves the contact mechanism to a pole open position side when the exciting coil is not energized;

the drive lever is fixed to either one of the electromagnetic device or contact mechanism, and contacts with the other with no gap at least when the contact mechanism is moved to the pole open position side;

a return force of the contact mechanism in a vicinity of the pole open position is made by the suction force of the permanent magnet, the drive lever is fixed to the electromagnetic device, a curved bulging portion contacting an end surface opposite to the return spring of the contact mechanism is formed for a predetermined distance inward from a leading end of the drive lever, and a lever retainer portion is formed on the contact mechanism and is brought into contact with a side opposite to that of the curved bulging portion.

4. An electromagnetic contactor according to claim 3, wherein the lever retainer portion is flexible and presses against the drive lever.

5. An electromagnetic contactor according to claim 3, wherein the electromagnetic device further includes a spool, a plunger slidably disposed inside the spool, and an armature fixed to one end of the plunger, said drive lever being integrally formed with the armature as one member and having rod portions with the curved bulging portion between the rod portions.

6. An electromagnetic contactor according to claim 1, wherein the contact mechanism further includes another movable contact attached to the movable contact support and another fixed contact so that when the movable contact contacts the fixed contact, the another movable contact is securely moved away from the another fixed contact.

7. An electromagnetic contactor according to claim 6, wherein the drive lever includes a curved bulging portion contacting an end surface of a lever retainer portion of the movable contact support at a side opposite to the return spring.

* * * * *

UNITED STATES PATENT AND TRADEMARK OFFICE

CERTIFICATE OF CORRECTION

PATENT NO. : 8,289,111 B2
APPLICATION NO. : 13/138029
DATED : October 16, 2012
INVENTOR(S) : Yasuhiro Naka et al.

It is certified that error appears in the above-identified patent and that said Letters Patent is hereby corrected as shown below:

In the Specifications

Please change column 7, line 3, "support plate portions" to --support plate portions 44--.

Signed and Sealed this
Seventh Day of May, 2013

Teresa Stanek Rea
*Acting Director of the United States Patent and Trademark Office*